US005727676A

United States Patent [19]

Tatsu et al.

[11] Patent Number: 5,727,676

[45] Date of Patent: Mar. 17, 1998

[54] APPARATUS FOR PREVENTING WET DAMAGE CAUSED BY DEW DROPS INSIDE A CONTAINER

[75] Inventors: Hisataka Tatsu, Kagoshima; Michiharu Suzuki, Funabashi, both of Japan

[73] Assignee: Kawasaki Kisen Kaisha, Ltd., Tokyo, Japan

[21] Appl. No.: 747,067

[22] Filed: Nov. 8, 1996

[30] Foreign Application Priority Data

Jul. 19, 1996 [JP] Japan ..... 8-007057 U

[51] Int. Cl.[6] ..... B65D 81/26; B65B 61/22

[52] U.S. Cl. ..... 206/204; 476/106; 476/118; 476/124

[58] Field of Search ..... 206/204, 205; 426/106, 124, 118, 419; 62/457

[56] References Cited

U.S. PATENT DOCUMENTS

| | | | |
|---|---|---|---|
| 1,481,971 | 1/1924 | Whiting | 206/204 X |
| 1,482,626 | 2/1924 | Whiting | 206/204 X |
| 1,601,625 | 9/1926 | Hnby | 206/204 X |
| 1,828,179 | 10/1931 | Gallagher | 426/124 X |
| 1,909,013 | 5/1933 | Ruzicka | 426/124 X |
| 4,061,785 | 12/1977 | Nishino et al. | 426/124 |
| 4,528,228 | 7/1985 | Clevenger | 426/419 X |
| 4,892,226 | 1/1990 | Abtahi | 206/204 X |

*Primary Examiner*—Bryon P. Gehman

*Attorney, Agent, or Firm*—Kane, Dalsimer, Sullivan, Kurucz, Levy, Eisele and Richard, LLP

[57] ABSTRACT

An apparatus for preventing wet damage caused by dew drops inside a container has a pair of side wall waterproof sheets for opposite side walls of the container, an entrance portion waterproof sheet for an entrance portion of the container, a rear wall waterproof sheet for a rear wall of the container opposite to the entrance portion, a ceiling waterproof sheet for a ceiling of the container, and a water absorptive sheet on the ceiling waterproof sheet. The side wall, rear wall and entrance portion waterproof sheets have a plurality of air holes provided near upper edges and are suspended on inner walls of the container so as not to reach a bottom portion of the container

5 Claims, 2 Drawing Sheets

Fig. 1A
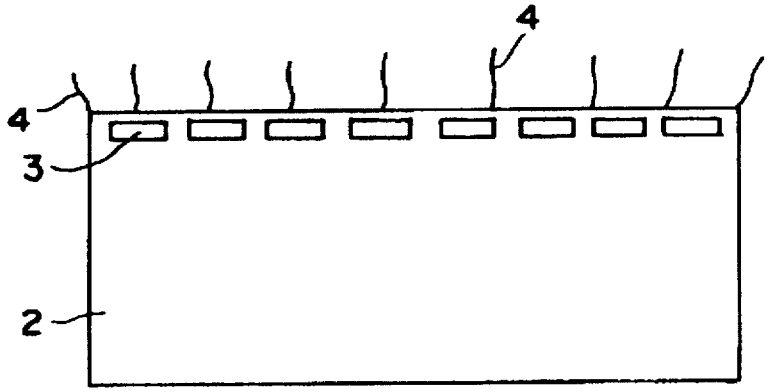
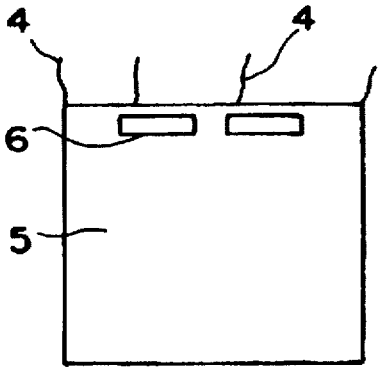
Fig. 1B
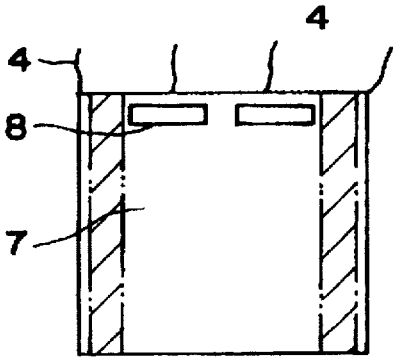
Fig. 1C
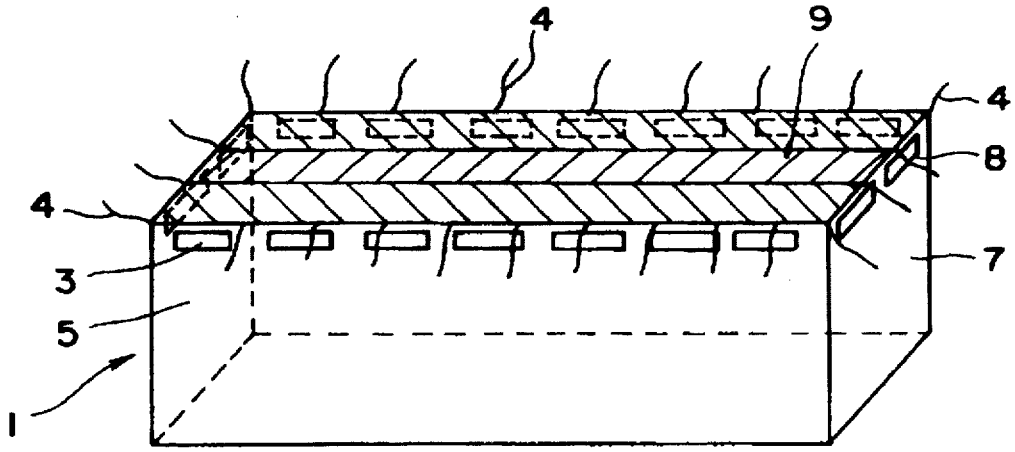
Fig. 2

APPARATUS FOR PREVENTING WET DAMAGE CAUSED BY DEW DROPS INSIDE A CONTAINER

BACKGROUND OF THE INVENTION

1. Field of the Invention

The present invention relates to an apparatus for preventing wet damage caused by dew drops in a container, and particularly relates to such a wet damage preventing apparatus which is constituted by waterproof sheets suspended inside a container to surround the ceiling and four sides of the container.

2. Description of the Related Art

In dry container transportation, conventionally, wet damage was caused in cargoes loaded in a container by dew drops which are generated in transportation from a warm area to a cold area, transportation in an area having a large temperature change between daytime and nighttime, and transportation of cargoes having a large moisture content.

According to a conventional technique, as an apparatus for preventing wet damage caused by dew drops by using a waterproof sheet, there are known an apparatus in which a waterproof sheet with a water absorptive sheet stuck thereon is suspended only on a ceiling portion of a container, an apparatus in which a water absorptive sheet is stuck through a double-sided bonding tape on a ceiling portion of a container, an apparatus of an inner bag system in which the whole circumference of cargo is surrounded by an inner bag, an apparatus in which gore textile is attached to a ceiling portion of a sheet, an apparatus in which the circumference of cargo is covered with corrugated paper or the like, and so on. In each of the above-mentioned apparatuses according to the conventional technique, however, damage caused by dew drops is prevented by use of a drying agent together, and there is no technique which can prevent wet damage due to dew drops perfectly.

SUMMARY OF THE INVENTION

It is therefore an object of the present invention to solve the foregoing problems in the conventional technique.

It is another object of the invention to provide an apparatus for perfectly preventing wet damage of cargo caused by dew drops produced on a ceiling portion, side wall portions, a rear wall portion and an entrance portion inside a container.

In order to attain the foregoing objects, according to an aspect of the present invention, an apparatus comprises waterproof sheets suspended so as to surround a ceiling and four sides of a container for preventing wet damage caused by dew drops inside the container, wherein the waterproof sheets includes a pair of side wall waterproof sheets for opposite side walls of the container, an entrance portion waterproof sheet for an entrance portion of the container, a rear wall waterproof sheet for a rear wall of the container opposite to the entrance portion, a ceiling waterproof sheet for a ceiling of the container, and a water absorptive sheet stuck on the ceiling waterproof sheet, wherein the side wall, rear wall and entrance portion waterproof sheets have a plurality of air holes provided near upper edges of the waterproof sheets and over the four sides of the container for discharging and circulating air inside enclosed by the waterproof sheets, and wherein the side wall, rear wall, entrance portion, and ceiling waterproof sheets are suspended like a mosquito net on inner walls of the container by suspending means such as strings or hooks so that skirt portions of the side wall, rear wall and entrance portion waterproof sheets do not reach a bottom portion of the container to thereby open between the skirt portions and the bottom portion of the container, whereby air currents of saturated damp air produced in the container circulate inside the container between the inside of the waterproof sheets and the inner walls of the container by a temperature difference between outside and inside of the container loaded with cargoes, so that dew drops falling down from a ceiling wall of the container are absorbed into the water absorptive sheet when the air currents reach the ceiling wall to generate the dew drops.

Preferably, each of the opposite side wall waterproof sheets, the rear wall waterproof sheet, the entrance portion waterproof sheet and the ceiling waterproof sheet is made from polyester resin.

Preferably, the water absorptive sheet is made from high polymeric water absorptive material.

Preferably, the water absorptive sheet is made from an exchangeable and reusable material.

In the apparatus for preventing wet damage caused by dew drops according to the present invention, the waterproof sheets are suspended on the walls of the container like a mosquito net inside the container so that the skirt portions of the waterproof sheets hanging near the bottom portion of the container are released from the container bottom portion, and the plurality of air holes are provided along the upper edges of the sheets, so that saturated air produced by moisture transpiration from cargoes covered with the waterproof sheets circulates inside the container constantly, goes out through the air holes, and reaches gaps between the sheet and a metal plate of the ceiling wall to generate dew drops on the surface of the metal plate. The dew drops fall down onto the water absorptive sheet so as to be absorbed and condensed in high polymeric water absorptive material of the water absorptive sheet. Since the water absorptive sheet is made from a water-impermeable material, there is no fear that water leaks from the water absorptive sheet. When there is a danger that dew drops are produced the cargoes are prevented in safety from wet damage due to dew drops only by suspending the waterproof sheets.

BRIEF DESCRIPTION OF THE DRAWINGS

FIGS. 1A, 1B and 1C are views illustrating sheets for preventing wet damage caused by dew drops inside a container, for use in an apparatus for preventing wet damage caused by dew drops inside a container according to the present invention, in which FIG. 1A shows a waterproof sheet for a side wall of the container, FIG. 1B shows a waterproof sheet for a rear wall of the container, and FIG. 1C shows a waterproof sheet for an entrance portion of the container;

FIG. 2 is a perspective view illustrating an apparatus for preventing wet damage caused by dew drops inside a container according to the present invention; and FIGS. 3A and 3B are central sectional views illustrating an apparatus for preventing wet damage caused by dew drops inside a container according to the present invention, in which FIG. 3A is a sectional view in the state where cargoes are loaded inside the container, and FIG. 3B is an enlarged view showing a part of FIG. 3A.

DETAILED DESCRIPTION OF THE PREFERRED EMBODIMENT

Figure 3A:
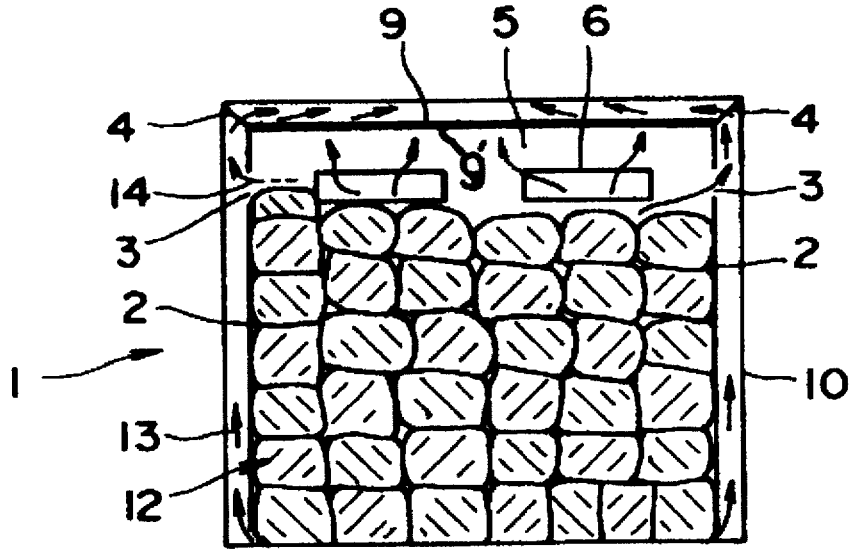

An embodiment of, the present invention will be described with reference to FIGS. 1A, 1B and 1C, FIG. 2, and FIGS. 3A and 3B.

FIG. 1A shows a waterproof sheet 2 for a side wall of a container. The container side wall waterproof sheet 2 has a plurality of air holes 3 formed along the upper edge of the sheet 2. The size of each of the air holes 3 is, for example, in 5 to 10 cm in vertical height and 30 to 60 cm in horizontal width in FIG. 1A. A plurality of suspending strings 4 are provided on the upper edge of the sheet 1. The suspending strings 4 are used to be hooked on lifting hooks fixed on the ceiling of the container or a rope 11 put around the ceiling as shown in FIG. 3B to thereby suspend the waterproof sheet 2. Accordingly, the suspending strings 4 may be replaced by mere hooks. FIG. 1B shows a waterproof sheet 5 for a rear wall of the container. The rear wall waterproof sheet 5 has a plurality of air holes similar to those in the waterproof sheet 2. Also in the rear wall waterproof sheet 5, a plurality of suspending strings 4 are attached to the upper edge portion of the sheet 5. The suspending strings 4 have the same function as those in the waterproof sheet 2. FIG. 1C shows a waterproof sheet 7 for an entrance portion of the container. The container entrance-portion waterproof sheet 7 has a plurality of air holes 8 and a plurality of suspecting strings 4 similar to those in the waterproof sheets 2 and 5. Preferably, each of the waterproof sheets 2, 5 and 7 may be a polyester resin sheet. The polyester resin sheet is in the form of a film, for example, approximately 0.1 mm thick. Alternatively, a polyethylene sheet may be used.

In FIG. 2, an apparatus 1 for preventing wet damage caused by dew drops inside a container is constituted by the side wall waterproof sheets 2 and 2 in pair, the rear wall waterproof sheet 5, the entrance portion waterproof sheet 7, and a container ceiling waterproof sheet 9' with a water absorptive sheet 9 stuck thereon. The side wall waterproof sheets 2, 2, 5 and 7, and the ceiling waterproof sheet 9' with the water absorptive sheet 9 stuck thereon are suspended on the inner walls of the container like a mosquito net as a whole in use by using the suspending strings or hooks 4. The water absorptive sheet 9 is detachably pasted in use, through a double-sided bonding tape, onto the ceiling waterproof sheet 9', so that reuse of the water absorptive sheet 9 is ensured, though such a water absorptive sheet is generally disposable hitherto. The water absorptive sheet 9 has a capacity of absorbing water of about 4 to 5 L per 1 $m^2$. Not a single but several water absorptive sheets 9 may be pasted to a ceiling waterproof sheet simultaneously in accordance with the properties of target cargoes. The water absorptive sheet 9 may be made from high polymers, fibers, etc. The size of the water absorptive sheet 9 may be set to be, for example, 0.8 m×6.0 m in accordance with the size of the container. The thickness of the water absorptive sheet 9 excluding the ceiling waterproof sheet 9' may be, for example, approximately 3 to 5 mm. This water absorptive sheet 9 is made from a material having conspicuously high absorptivity and retentivity of moisture or water.

Figure 3B:
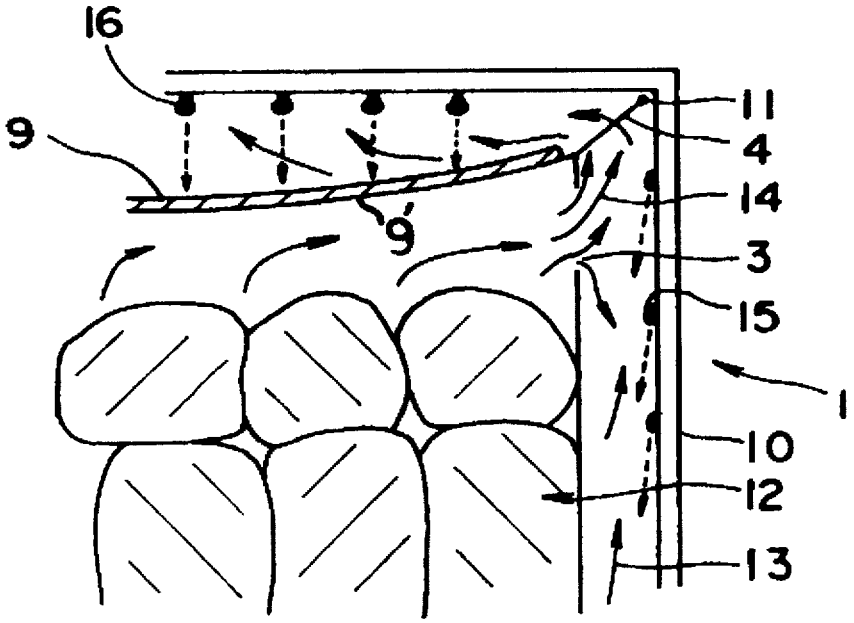

In FIGS. 3A and 3B, cargoes 12 such as grain, beans or the like are loaded in a container 10. In the container 10, the apparatus 1 for preventing wet damage caused by dew drops is provided inside the container 10. Specifically, the suspending strings or hooks 4 of the respective waterproof sheets 2, 5 and 7 and the suspending strings or hooks 4 of the ceiling waterproof sheet 9' with the water absorptive sheet 9 stuck thereon are hooked on the suspending hooks or rope 11 put around the ceiling portion of the container 10, so that the respective sheets are hooked and suspended like a mosquito net without distortion. In the container 10, an air layer in a sheet internal space surrounded by the sheets is made to be saturated air by the phenomenon of moisture transpiration from the cargoes 12, and the saturated air is discharged out of the inside of the sheets as a rising air current which rises along the inner walls of the container 10 outside the sheets as indicated by arrows 13. Further rising air currents are generated from the cargoes 12 along the arrows 14. The rising air currents 14 reach the ceiling portion of the container 10 through the air holes 3, 6 and 8 of the waterproof sheets 2, 5 and 7 respectively. Then, the rising air currents 14 contact with the container side walls to produce dew drops 15 thereon, and with the ceiling portion to produce dew drops 16 thereon. The dew drops 15 once reach the bottom portion of the container 10 along the container side walls, but the dew drops 15 rise again as saturated air. On the other hand, the dew drops 16 fall down on the water absorptive sheet 9 so as to be absorbed in the water absorptive sheet 9. The dew drops 16 are condensed in the high polymeric water absorptive material of the water absorptive sheet 9 disposed on the ceiling portion. Every time when the water absorptive sheet 9 has been used, the water absorptive sheet 9 is replaced by a new water absorptive sheet or a water absorptive sheet 9 which was used once but deaired, so that the influence of dew drops to the cargoes 12 can be eliminated surely.

In the apparatus for preventing wet damage caused by dew drops in a container according to the present invention, either the container entrance portion waterproof sheet or the side wall waterproof sheets are made longer than the wall portions of the container in the horizontal direction so that the adjacent waterproof sheets are overlapped on the horizontal edge portions. Specifically, for example, the respective side wall waterproof sheets are made longer than the opposite side walls of the container in the horizontal direction so that the horizontal edge portions of the respective side wall waterproof sheets are overlapped on the horizontal opposite edge portions of the entrance portion waterproof sheet in the hatched areas in the entrance portion shown in FIG. 1C to thereby close the openings between the adjacent sheets after cargoes are loaded. Alternatively, the entrance portion waterproof sheet may be made longer than the entrance wall of the container in the horizontal direction so that the horizontal opposite edge portions of the entrance portion waterproof sheet are overlapped on the horizontally edge portions of the respective side wall waterproof sheets in the not-shown areas on the respective horizontal edges of the side walls of the container to thereby close the openings between the adjacent sheets after cargoes are loaded. The entrance portion waterproof sheet is lifted up to the upper portion of the container when the cargoes are loaded or unloaded. The edges of the sheets are finished by sewing.

According to the present invention, it is possible to surely prevent wet damage caused by dew drops in dry container transportation of container-loaded cargoes under the condition of transportation from a warm area to a cold area, transportation in an area having a large temperature change between daytime and nighttime, or transportation of cargoes having a large moisture content. That is, waterproof sheets are hooked on the ceiling of a container like a mosquito net such that skirt portions of the sheets are opened and air holes are provided near the upper edges of the sheets, so that the saturated air inside the sheets and surrounded by the sheets is discharged out of the sheets easily, and circulated inside the container constantly, and dew drops can be absorbed in a water absorptive sheet surely. Accordingly, the apparatus is optimum for preventing cargoes from becoming stuffy or getting musty, that is, optimum for cargoes which repeat moisture condensation and transpiration. At that time, the ceiling and four sides inside the container are enclosed by the waterproof sheets made from water-impermeable polyester material, it is possible to prevent wet damage due to dew drops perfectly.

With the structure in which air circulates inside the container, the saturated damp air inside the waterproof sheets are discharged out of the sheets or circulated. Accordingly, it is not necessary to use an expensive textile such as gore textile used conventionally, or to take a step such as attachment of a water absorptive sheet to the sheet back to prevent dew drops from occurring inside the sheets. Thus, the structure contributes to the reduction of the cost.

According to the present invention, a ceiling waterproof sheet with a water absorptive sheet stuck thereon which is in the container can be replaced by a new one only by hooking and detaching the suspending strings or hooks of the waterproof sheet on or from suspending hooks fixed to the container ceiling, so that, unlike a conventional method where a water absorptive sheet is pasted to the ceiling portion directly or where only a sheet is attached to the ceiling portion, the operation of attaching and detaching the waterproof sheet is so easy that the time and labor of the attachment and detachment can be reduced on a large scale. There is a further advantage that the water absorptive sheet can be replaced by a new one and the removed one can be reused. This also contributes to the reduction of the cost.

With respect to cargoes which is high in the degree of contamination, the cargoes are surrounded by the waterproof sheets, so that the inner walls of the container are free from contamination, and the necessity of cleaning the container after unloading can be reduced to the utmost.

Even if there is water leakage caused by the failure of a container itself, prevention of wet damage can be attained.

The waterproof sheet can be reused repeatedly only by replacing the water absorptive sheet having absorbed enough water by a new water absorptive sheet every time when the dew drop water absorptive sheet has been used, resulting in reduction of the cost on a large scale. The combination of the waterproof sheet and the water absorptive sheet according to the present invention attains the reduction of the cost on a large scale in comparison with that in a conventional case where the waterproof sheet and a drying agent are disposable.

According to the present invention, unlike the conventional case, there is no fear that the prevention of wet damage caused by dew drops inside a container is stopped in failure due to the separation of a water absorptive sheet or the like, so that the reliability is extremely high.

The present invention has an effect higher than a conventional method where gore textile is used for a container ceiling portion and saturated air is discharged out of sheets, resulting in reduction of the cost.

The present invention can prevent wet damage caused by dew drops falling on and adhering to cargoes more perfectly than a conventional system where only a ceiling portion is suspended, or an inner bag system where the whole circumference is enclosed.

As an additional effect, the temperature difference of the temperature of the outside air from the temperature of the insides of waterproof sheets and spaces between the waterproof sheets and container side walls is useful for preventing damage caused by dew drops because the air layer insulated by the waterproof sheets in the container produces a heat-insulating effect so that the atmospheric temperature is not transmitted to the inside of the sheets directly. In addition, closing is not made between the skirt portions of the sheets and the bottom portion of the container, so that the air layer inside the waterproof sheets does not make cargoes get stuffy or musty, the air inside the container can be circulated easily, dew drops cannot enter the inside of the sheets, and no wet damage occur.

Cargo insurance can be reduced, and cargoes or goods can be sent instantaneously and put on show and on sale immediately after transportation.

The present invention can reduce the cost on a large scale in comparison with a conventional case using a drying agent.

The apparatus for preventing wet damage caused by dew drops inside a container according to the present invention can be applied broadly to imports and exports such as coffee beans, rice, various goods in a carton from Southeast Asia to Japan, various products, goods and so on from the US to Japan, and so on. Particularly when cargoes are exported in a container ship from Japan to the US, the container ship passes the North Pacific near the Aleutians and the Bering Sea which are cold sea areas, so that it is inevitable to generate dew drops in the container, and the effect of using this waterproof sheet is obvious. It has a large effect in shipping imports from an area such as Southeast Asia with high temperature and high humidity to Japan, or in shipping through an area where the production of dew drops can be foreseen, such as an area with a large temperature difference between daytime and nighttime.

What is claimed is:

1. An apparatus comprising waterproof sheets suspended so as to surround a ceiling and four sides of a container for preventing wet damage caused by dew drops inside said container;

wherein said waterproof sheets include a pair of side wall waterproof sheets for opposite side walls of said container, an entrance portion waterproof sheet for an entrance portion of said container a rear wall waterproof sheet for a rear wall of said container opposite to said entrance portion, a ceiling waterproof sheet for the ceiling of said container, and a water absorptive sheet on said ceiling waterproof sheet;

wherein said side wall, rear wall and entrance portion waterproof sheets each have a plurality of air holes provided near the upper edge thereof and the four sides of said container for discharging and circulating air inside the container and enclosed by said waterproof sheets; and wherein said side wall, rear wall, entrance portion, and ceiling waterproof sheets are suspended on inner walls of said container by suspending means so that skirt portions of said side wall, rear wall and entrance portion waterproof sheets do not reach a bottom portion of said container to provide on opening between said skirt portions and said bottom portion of said container, whereby air currents of saturated damp air produced in said container circulate inside said container between the inside of said waterproof sheets and the inner walls of said container by a temperature difference between outside and inside of said container loaded with cargo, so that dew drops falling down from said ceiling of said container are absorbed into said water absorptive sheet when said air currents reach said ceiling to generate the dew drops.

2. An apparatus for preventing wet damage caused by dew drops inside a container according to claim 1, wherein each of said opposite side wall waterproof sheets, said rear wall waterproof sheet, said entrance portion waterproof sheet and said ceiling waterproof sheet is made from polyester resin.

3. An apparatus for preventing wet damage caused by dew drops inside a container according to claim 1, wherein said water absorptive sheet is made from high polymeric water absorptive material.

4. An apparatus for preventing wet damage caused by dew drops inside a container according to claim 3, wherein said water absorptive sheet is made from an exchangeable and reusable material.

5. An apparatus for preventing wet damage caused by dew drops inside a container according to claim 2, wherein said water absorptive sheet is made from high polymeric water absorptive material.

* * * * *